US006925777B2

(12) United States Patent
Fresnel

(10) Patent No.: US 6,925,777 B2
(45) Date of Patent: Aug. 9, 2005

(54) METHOD AND A MACHINE FOR HEAT-SHRINKING HEAT-SHRINK SLEEVES ENGAGED INDIVIDUALLY ON ARTICLES SUCH AS BOTTLES

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 0 days.

(21) Appl. No.: 10/667,162

(22) Filed: Sep. 17, 2003

(65) Prior Publication Data

US 2005/0022469 A1 Feb. 3, 2005

(30) Foreign Application Priority Data

Jul. 31, 2003 (FR) ..... 03 09426

(51) Int. Cl.[7] ..... B65B 53/06

(52) U.S. Cl. ..... 53/399; 34/104; 34/437; 53/442; 53/557; 53/585; 156/86

(58) Field of Search ..... 53/441, 442, 397, 53/399, 141, 49, 556, 557, 585; 156/86; 34/104, 440, 437

(56) References Cited

U.S. PATENT DOCUMENTS

| | | | | | |
|---|---|---|---|---|---|
| 3,767,496 | A | * | 10/1973 | Amberg et al. | 156/86 |
| 3,802,942 | A | * | 4/1974 | Amberg et al. | 156/86 |
| 3,873,655 | A | | 3/1975 | Amberg et al. | 264/48 |
| 4,016,706 | A | | 4/1977 | Braker et al. | 53/14 |
| 4,072,553 | A | * | 2/1978 | Braker et al. | 156/86 |
| 4,092,382 | A | | 5/1978 | Heckman et al. | 264/25 |
| 4,172,873 | A | * | 10/1979 | Spicer | 156/86 |
| 4,248,030 | A | * | 2/1981 | Heckman | 53/442 |
| 4,325,762 | A | | 4/1982 | Burmeister et al. | 156/86 |
| 4,991,377 | A | * | 2/1991 | Marchesini | 53/478 |
| 5,031,298 | A | | 7/1991 | Fresnel | |
| 6,577,922 | B2 | * | 6/2003 | Gadrix et al. | 700/233 |

FOREIGN PATENT DOCUMENTS

| | | | | |
|---|---|---|---|---|
| DE | 4217520 A1 | * | 12/1993 | B67B/5/03 |
| EP | 0058602 A1 | * | 8/1982 | B65B/53/06 |
| EP | 0 952 084 A1 | | 10/1999 | |
| FR | 2564033 | * | 11/1985 | B29C/63/38 |
| FR | 2588828 | | 4/1987 | |
| FR | 2634274 | | 1/1990 | |
| FR | 2758387 | | 7/1998 | |
| FR | 2797944 | | 3/2001 | |
| GB | 1 485 942 | | 9/1977 | |
| GB | 2145963 A | * | 4/1985 | B29C/61/02 |
| JP | 4-311434 | * | 11/1992 | B65B/53/04 |

OTHER PUBLICATIONS

Copy of French Search Report Serial No. FR 635738 dated Apr. 5, 2004.

* cited by examiner

*Primary Examiner*—Stephen F. Gerrity
(74) *Attorney, Agent, or Firm*—McCormick, Paulding & Huber LLP

(57) ABSTRACT

The present invention relates to a method and to a machine for heat-shrinking sleeves made from a film of heat-shrink plastics material and engaged individually on articles such as bottles. In accordance with the invention, the machine comprises a fixed structure, an article support arranged to move along a vertical central axis between a low position in which articles can be put into place or removed, and a high position in which an article is fully received in a pre-heater chamber surmounting a shrinkage chamber, together with a controller governing parameters of temperature, support travel speed, and time, during the operating sequences of the method. This enables ordinary consumers themselves to cause sleeves to be shrunk onto bottles.

21 Claims, 4 Drawing Sheets

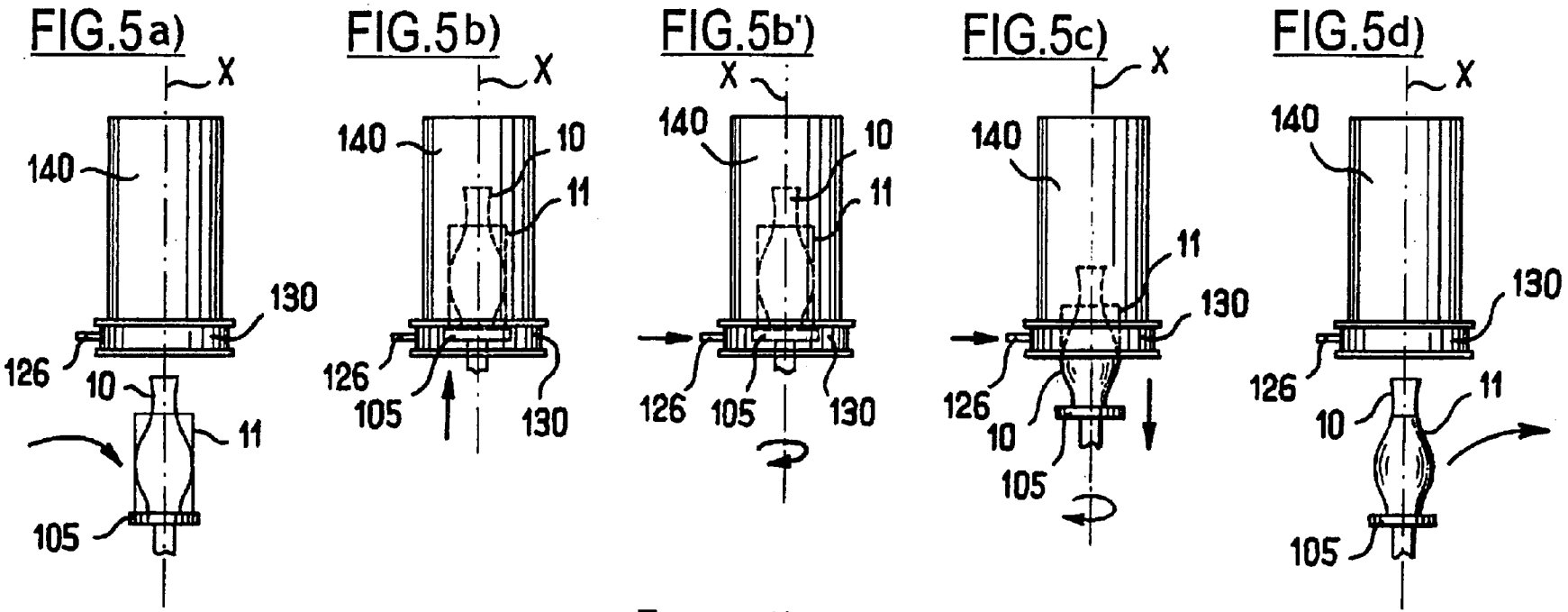
FIG.5a)
FIG.5b)
FIG.5b')
FIG.5c)
FIG.5d)
X
10
11
105
126
130
140
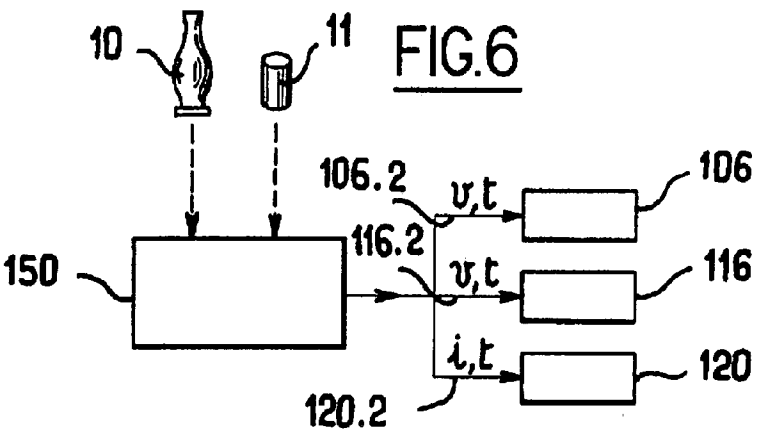
FIG.6
10
11
106
116
120
106.2
116.2
120.2
v,t
i,t
150

METHOD AND A MACHINE FOR HEAT-SHRINKING HEAT-SHRINK SLEEVES ENGAGED INDIVIDUALLY ON ARTICLES SUCH AS BOTTLES

This application is entitled to the benefit of and incorporates by reference essential subject matter disclosed in French Patent Application No. 0309426 filed on Jul. 31, 2003.

FIELD OF THE INVENTION

The present invention relates to the field of heat-shrinking sleeves made from a film of heat-shrink plastics material and engaged individually on articles such as bottles, for example.

BACKGROUND OF THE INVENTION

Continuously-operating shrinking machines have been in existence for about thirty years, and they are generally implemented in the form of a tunnel oven serving to shrink respective sleeves of heat-shrink plastics material engaged on articles which are placed on a conveyor belt forming the bottom of the shrinking tunnel. As each article travels on the conveyor belt from an upstream end towards a downstream end of the tunnel oven, the sleeve engaged on each article softens and then shrinks onto said article.

Very many techniques have already been implemented for controlling the anamorphic distortion of patterns printed on the sleeve during shrinking of said sleeve onto the article, and also for controlling the quality of sleeve shrinkage, which sleeve must be free from any curling or other imperfections on leaving the tunnel oven.

Amongst the numerous patent documents stemming from the Applicant, particular reference can be made to the following: FR-A-2 588 828, FR-A-2 634 274, FR-A-2 758 387, FR-A-2 797 944, and U.S. Pat. No. 5,031,298.

The various machines that have been made in this way are dedicated solely to industrial use in which it is desired to place sleeves on articles traveling at as high a rate of throughput as possible, and then to shrink the sleeves onto the associated articles, with the steps taking place continuously and solely in the presence of knowledgeable professionals.

A new need is now appearing that is associated with personalizing articles, and in particular bottles, with this being performed at the point of sale, leaving the consumer with the widest possible latitude in selecting a sleeve of desired appearance for shrinking onto an article. Unfortunately, machines of the above-described type are completely unsuitable for on-demand use by an average consumer who knows nothing about shrinkage phenomena.

There thus exists a need for a technique that is both simple and effective in enabling sleeves to be heat-shrunk individually and on demand by any ordinary consumer.

People in the profession have thus investigated how to make a small heat-shrink machine in the form of a small tunnel oven having an entrance where a consumer can place an article coated in a selected sleeve, and having an outlet from which the consumer can recover said article fitted with said sleeve shrunk onto it.

Unfortunately, it turns out that designing such machines of small dimensions is more difficult than was expected insofar as the articles concerned and the corresponding sleeves can vary to a very large extent.

In particular, a given article can be conditioned at temperatures that vary very greatly depending on the point of sale. This wide range of temperatures for the walls of articles has the effect of considerably modifying the conditions under which heat-shrink sleeves shrink onto said articles. It will naturally also be understood that the size of the article, and in particular variations in the section of such articles, likewise has a considerable effect on shrinkage conditions insofar as the amount of shrinkage required can vary considerably between the top and the bottom of the article. Finally, the thickness and the nature (polyethylene terephthalate (PET), polystyrene (PS), recyclable or not recyclable) of the film constituting the sleeve to be shrunk on the article can also vary and thus modify shrinkage conditions.

There thus exists an urgent need for a shrinkage technique which is both simple to implement and well adapted to on-demand use by ordinary consumers without the consumer needing to be concerned with making any adjustments as a function of the selected article and/or sleeve.

Ideally, a shrinkage technique should be made available suitable for being implemented under a very wide variety of conditions, in particular concerning the temperature at which the articles are conditioned prior to being covered in a heat-shrink sleeve.

SUMMARY OF THE INVENTION

An object of the invention is to provide a heat-shrink method and machine that are both simple to implement and suitable for dealing with the extremely wide variety of conditions that are to be encountered for articles and their associated heat-shrink sleeves, in particular concerning the temperatures involved, even though it is known that such conditions play an essential part in controlling the shrinking of sleeves on articles so as to obtain a finished state that is unblemished once shrinking has come to an end.

In accordance with the invention, the above-described technical problem is solved by a method of heat-shrinking sleeves made from a film of heat-shrink plastics material and engaged individually on articles such as bottles, the method comprising the following successive steps:

placing a single article on a moving support, a sleeve being engaged on said article;

transferring the article together with its sleeve into a pre-heater chamber at a controlled temperature, and maintaining said article in said chamber for a predetermined duration so as to prepare the film constituting the sleeve in optimum manner for subsequently shrinking the sleeve onto the article;

passing the article together with its sleeve at a controlled speed through a shrinkage chamber at controlled temperature, the shrinkage chamber being adjacent to the pre-heater chamber, thereby causing the sleeve to shrink onto the article; and removing the article coated in its shrunk-on sleeve from the support.

Preferably, the parameters of temperature, travel speed of the support, and time are controlled as a function of the article in question and of the film constituting the sleeve in question. In particular, the parameters are controlled by a programmable controller governing the sequences of operations implemented in said method.

Advantageously, the heating obtained in the pre-heater chamber is obtained by the effect of radiation.

Also preferably, the temperature that exists inside the shrinkage chamber is obtained by blowing in hot air and by diffusing the blown-in air. In particular, the air blown into the shrinkage chamber is also made use of periodically for maintaining the desired temperature inside the pre-heater chamber.

Also advantageously, the movement of the moving support while transferring the article into the pre-heater chamber and while causing said article to pass through the shrinkage chamber takes place along a single vertical direction. In particular, the support is caused to revolve at controlled speed about a vertical axis both before and during the passage of the article together with its sleeve through the shrinkage chamber.

Provision can then be made for the moving support to be caused to move axially at varying speed in order to optimize the duration of a complete cycle.

The invention also provides a heat-shrink machine for implementing a method presenting at least one of the above-specified characteristics, said machine being remarkable in that it comprises:

a stationary machine structure;

an article support mounted to move relative to the stationary structure along a vertical central axis between a low position for installing or removing an article, and a high position in which the article is fully contained in a pre-heater chamber surmounting a shrinkage chamber; and a controller governing the parameters of temperature, travel speed of the support, and time during the sequences of operations of the method.

Preferably, the article support is mounted to be capable also of revolving about its own central vertical axis. In particular, the article support is arranged to center the supported article on the vertical central axis, and possibly also to protect all or part of the bottom zone of said article.

Advantageously, the pre-heater chamber is constituted by a radiant chimney carried by the shrinkage chamber and centered on the vertical central axis of the article support. In particular, the radiant chimney is of variable wall thickness and/or cross-section in the event of there being significantly different shrinkage percentages between bottom and top zones of the sleeve to be shrunk onto the article.

According to another advantageous characteristic, the shrinkage chamber is annular in structure, and is centered on the vertical central axis of the article support.

In which case, it is preferable for the annular shrinkage chamber to be connected via a tube to a hot air blower assembly and to include components serving to diffuse the blown-in air, said chamber having a cylindrical inside wall presenting at least one slot for delivering the diffused hot air. In particular, the inside wall of the annular shrinkage chamber presents a plurality of slots which are inclined relative to the horizontal, and the components for diffusing the blown-in air are constituted by strips of metal wool.

Also preferably, the machine includes an elevator secured firstly to the article support and secondly to a motor for causing said article support to revolve, together with a motor actuating said elevator in order to cause the article support to move vertically axially, and the controller of said machine is connected to said two motors and to the hot air blower assembly associated with the annular shrinkage chamber in order to govern the various parameters of temperature, speed, and time. In particular, the controller is programmable specifically to take account of the dimensions of the article in question and the temperature of said article when it is put into place in said machine, and also to take account of the thickness and the nature of the film constituting the sleeve in question.

Advantageously, the machine includes a protective cover with a window enabling the article to be put into place and removed manually without any risk of touching hot parts of said machine.

Other characteristics and advantages of the invention appear more clearly in the light of the following description and the accompanying drawings, relating to a particular embodiment.

BRIEF DESCRIPTION OF THE DRAWINGS

Reference is made to the accompanying drawings, in which:

FIGS. 5*a*–5*d* are a diagram showing the steps in the heat-shrinking method implemented by the machine shown in the drawings, starting from placing a unit article with a sleeve engaged on said article and going to removal of said article coated in its shrunk-On sleeve; and FIG. 6 is a block diagram showing how a programmable controller controls the various parameters involved in the sequences of operations in the method of the invention.

DETAILED DESCRIPTION OF THE INVENTION

Figure 1:
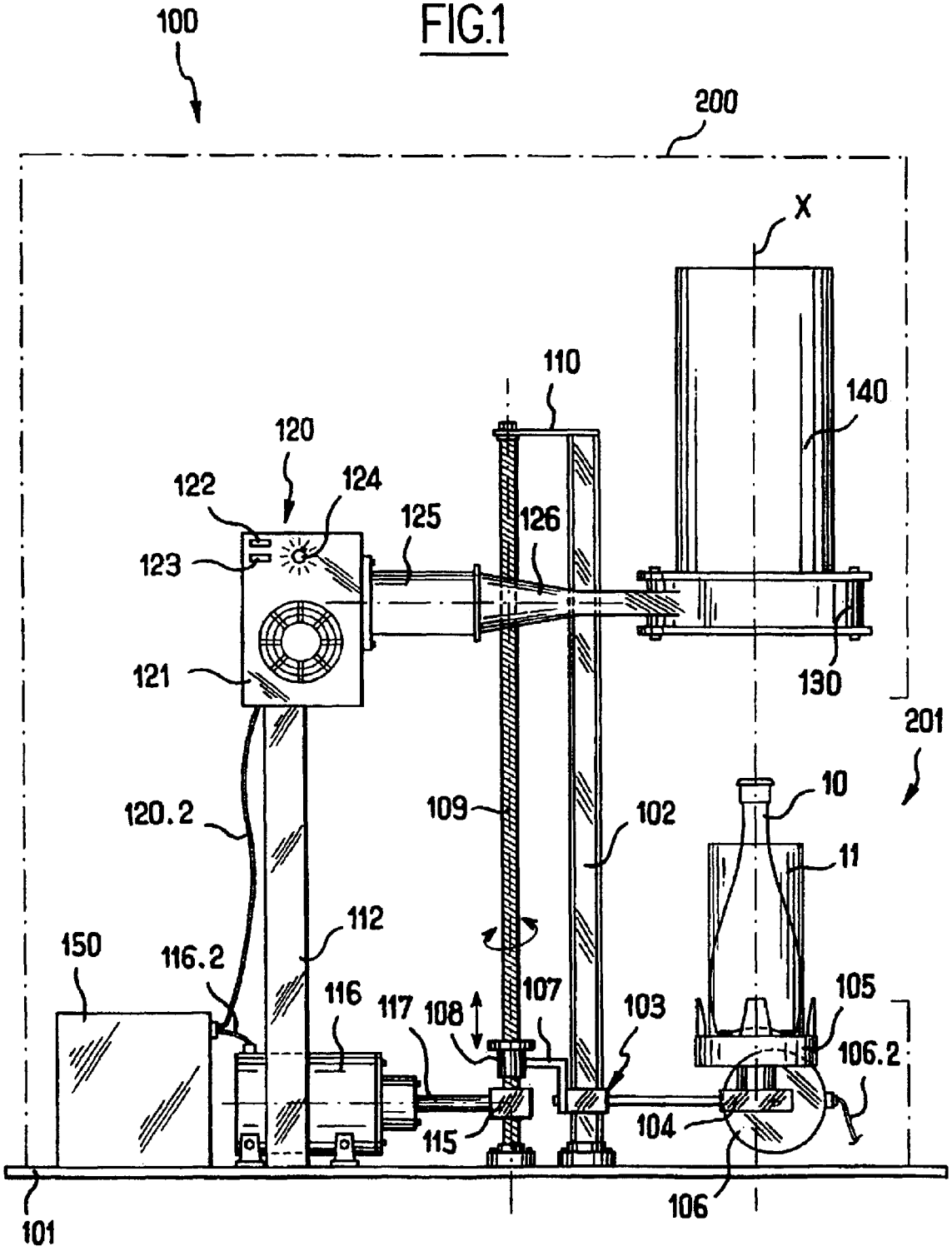
FIG. 1 is an elevation view showing a heat-shrink machine implementing the method of the invention.
Figure 2:
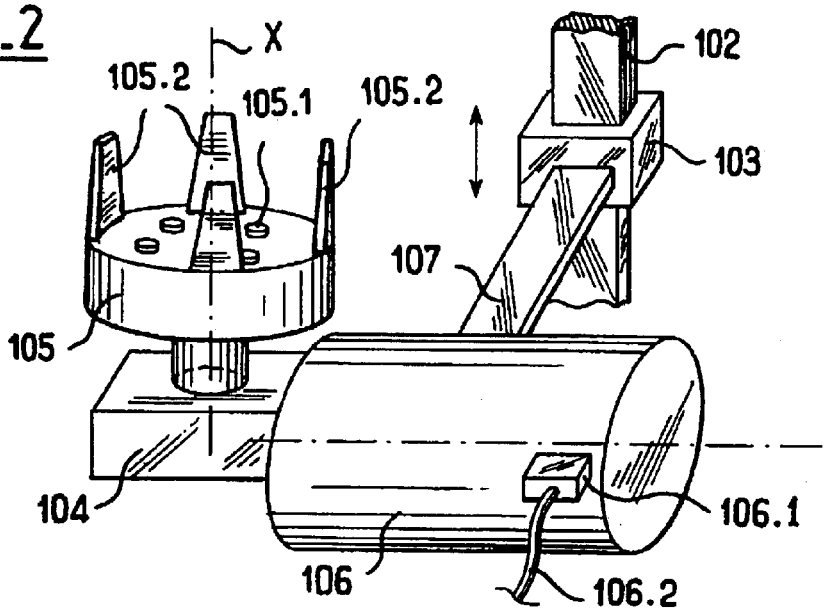
FIG. 2 is a detail view in perspective showing the article support together with its rotary drive motor.
Figure 3:
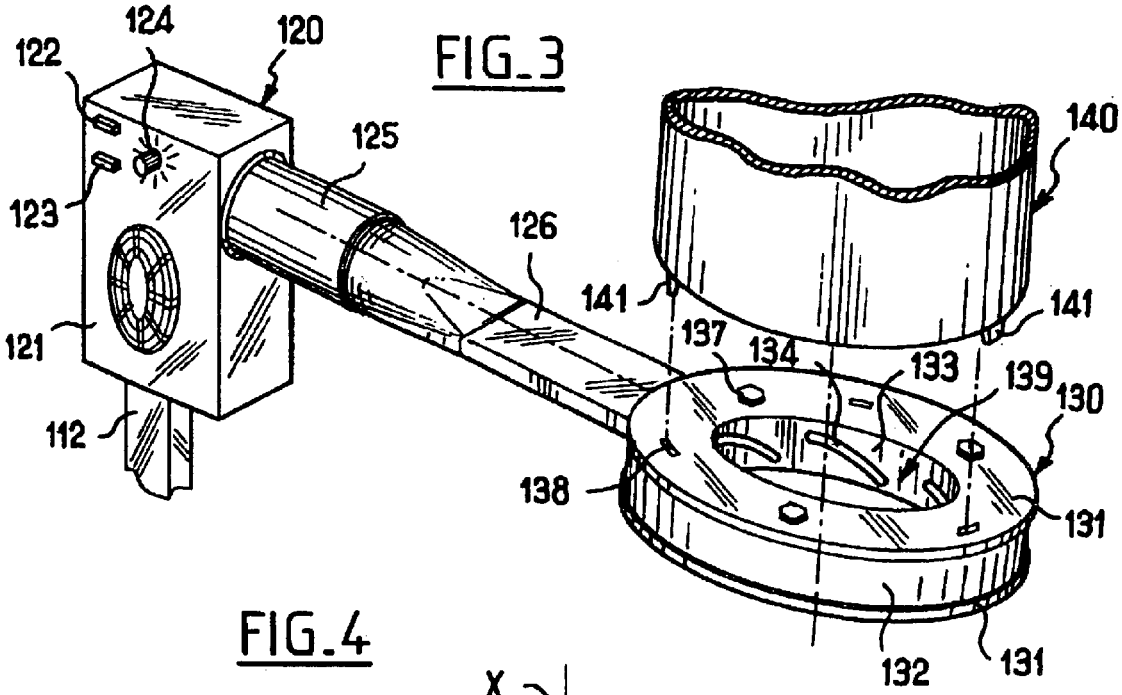
FIG. 3 is a detail view in perspective showing the annular shrinkage chamber of the machine and the associated hot air blower assembly, said chamber being surmounted by a chimney which is shown in this figure in an exploded view, and which forms the pre-heating chamber of the machine.

With reference to FIGS. 1 to 3, the description begins with a heat-shrink machine in accordance with the invention for implementing a method of heat-shrinking sleeves made from a film of heat-shrink plastics material and engaged individually on articles such as bottles.

Although bottles are referred to specifically herein, and do indeed represent a preferred field of application, the invention is not limited in any way to articles of this type, and can be applied equally well to other types of container or to other types of article for coating in a heat-shrink sleeve of appearance that is desired by the consumer.

The figures show a heat-shrink machine 100 for heat-shrinking sleeves made from a film of heat-shrink plastics material that are individually engaged on articles such as bottles. The figure shows a bottle 10 having a sleeve referenced 11 associated therewith, the sleeve being put into place around said bottle.

The machine 100 comprises a stationary structure 101, in this case implemented in the form of a support plate having a variety of components placed thereon. It is preferably provided with a protective cover allowing the article 10 to be put into place and removed by hand, while avoiding any risk of touching hot parts of the machine 100. Such a protective cover 200 is represented by chain-dotted lines and it presents a window 201 giving access to the region of an article support on which the consumer places the single article 10 together with a sleeve 11 engaged around said article, and from which the consumer subsequently retrieves the assembly after said sleeve has been shrunk onto said article.

The fixed structure 101 carries a vertical column 102 which constitutes a guide element for an elevator slider 103 which is associated with said column 102. The elevator slider 103 has an assembly cantilevered out therefrom comprising a unit 104 with an article support 105 installed on top. A motor 106 forms part of this vertically movable assembly and serves to cause the article support 105 to revolve about a central vertical axis X. The motor 106 is preferably an electric motor, but in a variant it could be driven pneumatically. A connector 106.1 is associated with the drive motor 106, and a connecting cable 106.2 can be seen in FIG. 2 leading to a general unit 150 which is constituted by a programmable controller for controlling the sequences of operations implemented in the heat-shrink method of the invention.

The above-described moving equipment, including in particular the article support 105 with its associated motor 106, can thus be moved in a vertical direction with its movement being guided by the column 102 on which the elevator carriage 103 slides.

The article support 105 is thus mounted to move relative to the stationary structure 101 along the vertical central axis X, and to do so between a low position for installing or removing an article (the position shown in FIG. 1) and a high position in which the article 10 is fully contained in a pre-heater chamber 140 which surmounts an annular shrinkage chamber 130. The above-mentioned chambers 130 and 140 are described in greater detail below with reference to FIGS. 3 and 4.

Although not essential, the article support 105 is in this case mounted so as to be capable of revolving about its vertical central axis X, with such rotation being found to be advantageous during the shrinkage step proper during which the sleeve is shrunk onto the article.

In order to move the above-described moving assembly including the article support 105 along the vertical axis, a screw-and-nut type drive assembly is provided. The elevator slider 103 is extended by a bracket 107 which is connected to a nut 108 engaged on the thread of a vertical axis threaded rod 109 interposed between the structure 101 and a top plate 110 connecting it to the column 102 so as to ensure that said threaded rod 109 extends accurately vertically. The threaded rod 109 is nevertheless not secured to the structure 101 or to the plate 110, but is free to turn about its own vertical axis under drive from associated drive means which are constituted by a motor 116 whose outlet shaft 117 is connected to a gearbox 115 engaging the threaded rod 109. The motor 116 is preferably an electric motor, but in a variant it could be driven pneumatically. The electric motor 116 is connected by a cable 116.2 to the general controller 150 of the machine. Thus, when the electric motor 116 is excited so as to cause its outlet shaft 117 to turn in one direction or the other, this causes the threaded rod 109 to rotate about its own axis in the corresponding direction, and consequently causes the nut 108 to move up or down. The upward or downward movement of the nut 108 serves to move the moving equipment, and in particular the article support 105, axially.

The moving equipment is moved axially between two specified levels, a bottom level which corresponds to the position in which an article is put into place or removed, and a top level which corresponds to said article being received inside the pre-heater chamber 140. Provision is naturally made for end-of-stroke sensors to be associated with these two specific positions, e.g. sensors co-operating with the elevator slider 103. Each of these two sensors is naturally connected to the control circuit of the motor 116 and to the general controller 150 (where such sensors are of conventional design and are not shown herein).

With reference again to FIG. 2, it can be seen that the article support 105 is arranged to hold the supported article on the vertical central axis X, with this being done by means of projecting studs 105.1. When the article support 105 is caused to revolve about its central axis X it is appropriate for the article, which itself generally presents its own vertical central axis, to be properly positioned on the vertical axis of rotation of the article support 105. There can also be seen vertical fingers projecting from the periphery of the article support 105, these fingers being referenced 105.2. Equipped in this way, the article support 105 is thus capable of protecting all or part of the bottom region of the article that is placed thereon by means of the fingers 105.2 forming heat screens when the base of the article is subjected to a temperature field seeking to shrink the sleeve engaged on said article.

FIG. 1 also shows a vertical column 112 rigidly secured to the structure 101 of the machine, and having a hot air blower assembly 120 mounted on its top end. This assembly 120 comprises a box 121 containing an electric fan and an electric resistance element that generates heat by infrared radiation when said element is passing an electric current. This hot air blower assembly 120 is connected by a cable 120.2 to the general controller 150 of the machine for the purpose of controlling the temperature of the hot air blown out from the blower assembly 120. The box 120 has an on/off button 122 mounted on a side surface thereof together with an indicator lamp 123 and a manual adjustment knob 124 enabling the electric current carried by the heater element to be varied on the spot, thus enabling the temperature of the air blown out by said hot air blower assembly 120 to be modulated.

The hot air outlet is constituted by a cylindrical sleeve 125 rigidly secured to the box 121 of the assembly 120, which sleeve carries a nozzle 126, in turn connected to an assembly that is of annular structure in this case and that forms the shrinkage chamber 130, which chamber is surmounted by the pre-heater chamber 140. Specifically, the two chambers 130 and 140 are thus supported in a cantilevered-out position by the tubes 125 and 126 that are fixed to the box 121 of the hot air blower assembly 120. Naturally, an auxiliary support could be provided, of structure designed to withstand the temperatures involved.

Figure 4:
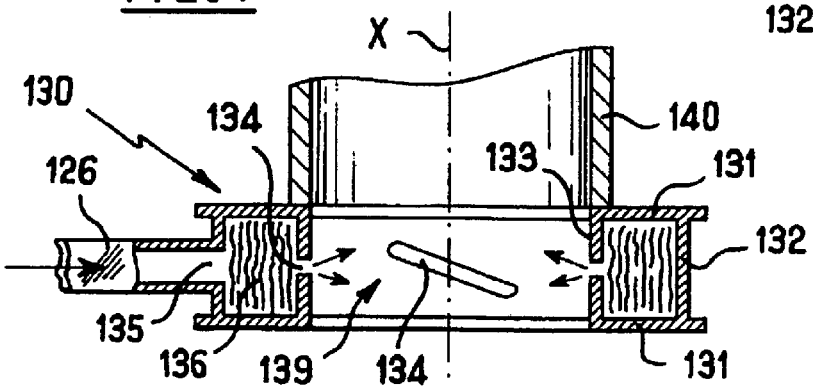
FIG. 4 is an axial section view of the annular shrinkage chamber and of the pre-heating chamber mentioned above, showing more clearly the means that enable the blown hot air to be diffused.

FIGS. 3 and 4 make it easier to understand the specific structure and shape of the chambers 130 and 140.

The annular shrinkage chamber 130 is held relative to the vertical central axis X and its top and bottom are defined by flat rings 131 having a cylindrical outside wall 132 and a cylindrical inside wall 133 extending between them. The annular housing defined in this way is fed with hot air blown through the connection at 135 to the nozzle 126. The hot air thus admitted into the annular space of the chamber 130 can escape only through openings which in this case are formed as slots 134. These slots 134 are formed through the inside wall 133 of the annular shrinkage chamber 130 and they slope relative to the horizontal so as to ensure high-quality shrinkage of the bottom portion of the sleeve engaged on the article.

The cylindrical inside wall 133 thus defines a central passage 139 whose axis coincides with the vertical central axis X of the above-described article support 105 and of diameter that is slightly greater than the outside diameter of said article support 105. The article support 105 together with the article it is carrying and that has the sleeve for shrinking engaged thereon can thus be caused to pass into said central space 139, initially to bring the article and its sleeve into the pre-heater chamber 140, and then to cause the article during subsequent lowering thereof to pass through the annular shrinkage chamber 130.

It should also be observed in FIG. 4 that components referenced 136 are provided to diffuse the air blown in through the inlet 135. Care needs to be taken to ensure that the air escaping through the outlet slots 134 does not exert any excessive pressure on the outside wall of the sleeve while said sleeve is moving past said slots. By way of example, the above-mentioned components 136 may be constituted by metal wool strips installed in the annular space of the chamber 130.

The pre-heater chamber 140 is constituted by a radiating chimney carried by the annular shrinkage chamber 130 and centered on the axis X thereof. To ensure that the chimney 140 is properly centered, it has downwardly-extending tabs 141 which are received in corresponding holes 138 formed in the top ring 131 of the chamber 130. In FIG. 3, there can be also be seen the heads of bolts 137 holding together the two rings 131 that define the annular shrinkage chamber 130.

It is important to observe that the chimney 140 is a radiant chimney, i.e. that its top opening does indeed open out, and that its inside surface produces heat by radiation only, to the exclusion of any particular heater elements being present. The chimney 140 can be made of stainless steel, for example.

Figure 4A:
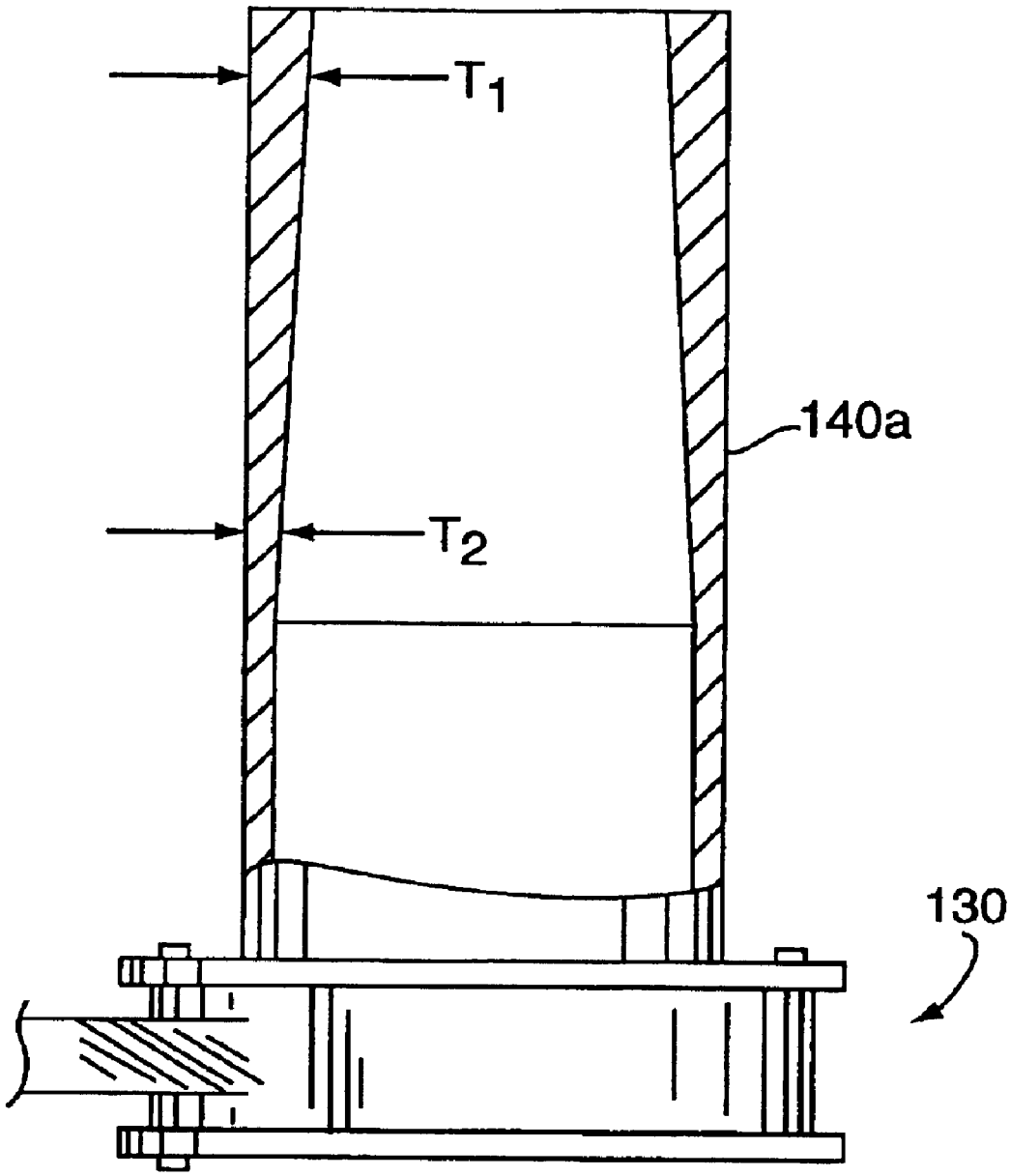
FIG. 4A is an axial section view of an annular shrinkage chamber and a pre-heating chamber according to another embodiment of the invention.

If the article in question is of section that varies little, then the shrinkage percentage of the associated sleeve will likewise vary little. Under such circumstances, a chimney 140 that is cylindrical in shape will suffice, the chimney being of constant thickness from one end to the other. However, in some situations, the shrinkage percentage can vary considerably up the height of the article, in particular from top to bottom of said article. As shown in FIG. 4A, under such circumstances, it may be advantageous to vary the inside section of a chimney 14O*a* accordingly. Provision could than be made for the wall thickness $T_1$, $T_2$ of the chimney 140*a* and/or its cross-section to vary. Naturally, provision could be made for the chimney to have a top portion that tapers conically and that is fitted to the top of a main portion that is cylindrical.

Reference is now made to FIG. 5 which shows the various steps of the heat-shrink method of the invention.

Position a) constitutes a preliminary step in which a single article 10 is put into place on the moving support 105, a sleeve 11 being engaged on said article. Sufficient space is naturally provided between the article support 105 in its lowest position and the bottom of the annular shrinkage chamber 130 to ensure that it is easy to place an article on the support 105, whatever the height of the article.

In position b), the article 10 together with its sleeve 11 is being transported into the pre-heater chamber 140 which is at a controlled temperature. It can be seen that the article support 105 then forms a kind of plug practically closing off the bottom portion of the annular shrinkage chamber 130. The article 10 is raised by the associated elevator in such a manner that the bottom portion of the article is at least above the level of the top of the hot air outlet slots 134. The article is then maintained inside the pre-heater chamber 140 for a predetermined duration in order to prepare the film constituting the sleeve 11 appropriately for being shrunk subsequently onto the article 10. This pre-heating step is essential for obtaining good shrinkage of the sleeve onto the article while taking account of all of the characteristics of the article in question, and in particular the temperature of said article and its dimensions, and also the characteristics of the film constituting the heat-shrink sleeve in question, and in particular the thickness and the nature of said film. The temperature that exists inside the pre-heater chamber 140 and the length of time the article together with its sleeve remain inside said chamber are controlled by the general controller 150. This controller 150 is preferably programmable, in particular in order to take account of the dimensions of the article 10 in question and in order to take account of its temperature when initially placed inside said machine, while also taking account of the thickness and the nature of the film constituting the sleeve 11 in question.

Shortly before the end of the time spent by the article in the pre-heater chamber 140, the air blown by the air blower assembly 120 begins to be heated so that the air escaping through the slots 134 of the annular shrinkage chamber 130 is at a previously-selected temperature. Once this predetermined temperature has been reached, the article support 105 is caused to revolve about its central axis X, as shown in position b').

The following step then begins, which step consists in causing the article 10 together with its sleeve 11 to pass at controlled speed through the annular shrinkage chamber 130 that is itself at controlled temperature, for the purpose of shrinking the sleeve 11 onto the article 10. In position c), an intermediate situation is shown where the article 10 has passed part of the way through the annular shrinkage chamber 130, which is why only the bottom portion of said sleeve is shown as being shrunk onto the article.

As the moving equipment together with the article continues to move downwards, the full height of the sleeve moves past the air outlet slots in the annular shrinkage chamber 130 thus leading to final shrinkage of the sleeve onto the article.

This leads to the situation shown in position d), where the article support 105 has returned to its bottom position, this position corresponding to the article 10 coated in its shrunk-on sleeve 11 being removed from the support 105.

It will be understood that the parameters of temperature, travel speed of the support 105, and time are all controlled by the programmable controller 150 as a function of the article 10 in question and as a function of the film constituting the sleeve 11 in question. The programmable controller 150 serves to govern all of the operating sequences implemented in the method, thus controlling all of the parameters involved.

FIG. 6 is a diagram representing the above-described control performed by the programmable controller 150.

By means of the connection 106.2, the motor 106 receives instructions concerning speed (v) and operating time (t) for each of the steps of the method. Similarly, the connection 116.2 sends the speed and time instructions (v, t) to the motor 116 which moves the moving equipment axially. The connection 120.2 serves to deliver the instructions (i, t) needed by the hot air blower unit 120 for determining electric current and time in order to ensure that the desired temperature is obtained in the annular shrinkage chamber 130.

It can be seen from this diagram that no control is applied to the temperature that exists inside the pre-heater chamber 140. This results from the fact that provision is made in this case for the hot air blown into the annular shrinkage chamber 130 to be made use of periodically for maintaining the desired temperature inside the pre-heater chamber 140. This makes it possible to avoid having special means associated with the temperature field that exists inside the chimney 140, while nevertheless being certain that the heating effect obtained inside said pre-heater chamber is obtained solely by the radiant effect. The temperature that exists inside the shrinkage chamber 130 is naturally obtained by blowing in hot air and by the blown air being diffused as described above.

In the diagram of FIG. 6, dashed lines represent the storage of data associated both with the articles that might be involved and with the films constituting their associated sleeves. Naturally, data relating to the temperatures involved is also programmed so as to be able to control the operation of the machine automatically in any country in the world, in particular in association with bottles having temperatures lying in the range 3° C. to an ambient temperature of 35° C. to 40° C.

As an indication, there follow a few numerical values for the various operating parameters, it being understood that these constitute illustrative examples only.

For the preconditioning stage, after the article and the sleeve placed around said article have been put into place on the article support, it is ensured that the article is held stably, possibly while also ensuring that sensitive zones are protected, and the moving equipment is caused to rise at a speed of about five meters per second.

For the pre-heating step, the design temperature inside the pre-heater chamber 140 is about 50° C. to 80° C. and the time the article is maintained in said chamber lies in the range about three seconds to about twenty seconds. It should be observed that the temperature is generally considerably higher in the bottom portion of the chimney forming the pre-heater chimney 140, with the temperature in the bottom portion being 75° C. to 80° C., for example, while the temperature in the top portion of said chimney is about 40° C. to 50° C.

For the shrinking step proper, hot air is blown in at a temperature of about 80° C. to 90° C. The article support is caused to revolve at a speed of about 110 revolutions per minute, and the article is caused to pass through the annular shrinkage chamber 130 at a speed that is preferably uniform and about five meters per second. Once the article has been fully extracted from the annular shrinkage chamber 130, it is optionally possible to accelerate the downward movement of the moving equipment in order to reduce total cycle time.

As an indication, on the basis of the above parameters, a complete cycle may have a duration of abut one minute.

The invention is not limited to the embodiments described above, but on the contrary covers any variant using equivalent means to reproduce the essential characteristics specified above.

In particular, although the description relates to a single sleeve being placed and shrunk onto an article, it is possible to provide for a single article to be associated with a plurality of superposed sleeves which are put into place and shrunk on, either simultaneously or in succession. Likewise, the single sleeve may occupy only a small fraction of the article, for example its top portion, its middle portion, or its bottom portion, as appropriate.

What is claimed is:

1. A method of heat-shrinking sleeves made from a film of heat-shrink plastics material, the method comprising:

placing an article on a support configured for movement at one or more travel speeds, a heat-shrinking sleeve being engaged on the article;

moving the support at a first travel speed to transfer the article together with the sleeve into a pre-heater chamber having a first temperature range;

maintaining the article in the pre-heater chamber for a predetermined time;

moving the support vertically at a second travel speed to pass the article together with the sleeve from the pre-heater chamber to a shrinkage chamber having a second temperature range, the shrinkage chamber being adjacent to the pre-heater chamber, thereby causing the sleeve to shrink onto the article; and removing the article coated in its shrunk-on sleeve from the support.

2. A method according to claim 1, further comprising controlling a set of parameters including at least one of the first and second temperature ranges, at least one of the first and second travel speeds of the support, and the time as a function of the article and of the film constituting the sleeve.

3. A method according to claim 2, wherein the set of parameters are controlled by a programmable controller.

4. A method according to claim 1, wherein the temperature range in the pre-heater chamber is obtained by the effect of radiation.

5. A method according to claim 1, further comprising blowing and diffusing hot air into the shrinkage chamber to obtain the second temperature range.

6. A method according to claim 5, further comprising using air exiting the shrinkage chamber to maintain the first temperature range inside the pre-heater chamber.

7. A method according to claim 1, wherein moving the support to transfer the article into the pre-heater chamber and moving the support to pass the article through the shrinkage chamber takes place along a single vertical axis.

8. A method according to claim 7, further comprising revolving the support at a controlled rotational speed about the vertical axis both before and during the passage of the article together with its sleeve through the shrinkage chamber.

9. A method according to claim 7, wherein at least one of the first travel speed and the second travel speed vary in order to optimize the duration of a complete cycle.

10. A heat-shrink machine for heat-shrinking sleeves made from a film of heat-shrink plastic material onto an article, the machine comprising:

a stationary machine structure;

a shrinkage chamber having a temperature range, the shrinkage chamber being mounted to the stationary machine structure;

a pre-heater chamber surmounting the shrinkage chamber;

an article support mounted to move at a travel speed relative to the stationary structure along a vertical axis between a low position for installing or removing the article, and a high position in which the article is fully contained in the pre-heater chamber for a period of time; and a controller to control the temperature range of the shrinkage chamber, the travel speed of the support, and the period of time.

11. A machine according to claim 10, wherein the article support is configured to revolve about the vertical axis.

12. A machine according to claim 10, wherein the article support is arranged to center the article on the vertical axis, and to protect all or part of a bottom zone of the article.

13. A machine according to claim 10, wherein the preheater chamber includes a radiant chimney carried by the shrinkage chamber and centered on the vertical axis of the article support.

14. A machine according to claim 13, wherein the radiant chimney has at least one of a variable wall thickness and a variable cross-section.

15. A machine according to claim 10, wherein the shrinkage chamber is annular in structure, and is centered on the vertical axis of the article support.

16. A machine according to claim 15, wherein the annular shrinkage chamber receives blown-in air from a hot air blower assembly, the shrinkage chamber including components to diffuse the blown-in air and, a cylindrical inside wall presenting at least one slot for delivering the diffused hot air.

17. A machine according to claim 16, wherein the inside wall of the annular shrinkage chamber presents a plurality of slots which are inclined relative to the horizontal.

18. A machine according to claim 16, wherein the components for diffusing the blown-in air include strips of metal wool.

19. A machine according to claim 16, including an elevator secured to the article support which is mounted to be capable also of revolving about its own central vertical axis and to a first motor for causing the article support to revolve at a rotational speed around the vertical axis, and a second motor actuating said the elevator in order to cause the article support to move vertically axially, and wherein the controller of the machine is connected to the first and second motors and to the hot air blower assembly associated with the annular shrinkage chamber in order to govern the temperature range of the shrinkage chamber, the travel speed of the support along the vertical axis, the rotational speed of the support around the vertical axis, and the period of time.

20. A machine according to claim 19, wherein the controller is programmed as a function of the dimensions of the article, the temperature of the article when placed on the support, and the thickness and the material of the film constituting the sleeve.

21. A machine according to claim 10, including a protective cover with a window enabling the article to be placed on and removed manually from the support, the protective cover reducing a risk of an operator touching hot parts of the machine.

* * * * *